US012714203B2

(12) United States Patent
Rüegg et al.

(10) Patent No.: US 12,714,203 B2
(45) Date of Patent: Aug. 25, 2026

(54) SHOE WITH DUAL LACE

(71) Applicant: ON CLOUDS GMBH, Zürich (CH)

(72) Inventors: Martin Rüegg, Zürich (CH); Nils Altrogge, Zürich (CH)

(73) Assignee: ON CLOUDS GMBH, Zürich (CH)

( * ) Notice: Subject to any disclaimer, the term of this patent is extended or adjusted under 35 U.S.C. 154(b) by 120 days.

(21) Appl. No.: 18/273,613

(22) PCT Filed: Jan. 19, 2022

(86) PCT No.: PCT/EP2022/051058
§ 371 (c)(1),
(2) Date: Jul. 21, 2023

(87) PCT Pub. No.: WO2022/161819
PCT Pub. Date: Aug. 4, 2022

(65) Prior Publication Data

US 2024/0081483 A1 Mar. 14, 2024

(30) Foreign Application Priority Data

Jan. 27, 2021 (CH) ..... 0074/21

(51) Int. Cl.
*A43C 1/00* (2006.01)
*A43B 5/06* (2022.01)
(Continued)

(52) U.S. Cl.
CPC ..... *A43C 1/003* (2013.01); *A43B 5/06* (2013.01); *A43C 1/06* (2013.01); *A43C 9/00* (2013.01);
(Continued)

(58) Field of Classification Search
CPC ..... A43C 1/003; A43C 11/008; A43C 1/00; A43C 1/04; A43C 9/00; A41F 1/04; Y10T 24/45885
(Continued)

(56) References Cited

U.S. PATENT DOCUMENTS 273,706 A * 3/1883 Bray ..... A43C 3/00 24/714.5
492,193 A 2/1893 Crews
(Continued)

FOREIGN PATENT DOCUMENTS

EP 3 190 916 7/2017
WO WO 2016/039879 A1 3/2016

OTHER PUBLICATIONS

EPO (Rijswijk, NL), English language version of the International Search Report, Form PCT/ISA/210, for International Application PCT/EP2022/051058, May 2, 2022 (2 pages).

*Primary Examiner* — Grady Alexander Nunnery
(74) *Attorney, Agent, or Firm* — Pauley Erickson & Swanson

(57) ABSTRACT

A shoe including a shoe tip and a heel edge and a lacing system, wherein the lacing system includes lacing comprising two end regions and a middle region adjoining between the end regions on respective branching points, and wherein the lacing branches into a first strand and a second strand at the branching points. The shoe includes a holder with holding structure pairs for fastening the lacing having a medial-side and an opposite holding structure arranged on the lateral side. The holder includes from the shoe tip first holding region at least one holding structure pair and an adjoining second holding region arranged in the direction of the heel edge including at least two holding structure pairs. The first strand is fastened to the holding structure pairs in
(Continued)

the first holding region, and the second strand is fastened to the holding structure pairs in the second holding region.

16 Claims, 3 Drawing Sheets

(51) Int. Cl.

| | |
|---|---|
| ***A43C 1/06*** | (2006.01) |
| ***A43C 3/00*** | (2006.01) |
| ***A43C 5/00*** | (2006.01) |
| ***A43C 9/00*** | (2006.01) |
| ***A43D 8/00*** | (2006.01) |
| ***A43D 25/00*** | (2006.01) |
| ***A43D 98/00*** | (2006.01) |

(52) U.S. Cl.
CPC ..... *A43D 8/00* (2013.01); *A43D 25/00* (2013.01); *A43D 98/00* (2013.01); *A43C 3/00* (2013.01); *A43C 5/00* (2013.01)

(58) Field of Classification Search
USPC ..... 24/683, 713.4; 12/142 LC
See application file for complete search history.

(56) References Cited

U.S. PATENT DOCUMENTS

| | | | | |
|---|---|---|---|---|
| 4,200,998 | A * | 5/1980 | Adams | A43C 1/00 36/50.1 |
| 2004/0078999 | A1 * | 4/2004 | Freed | A43C 11/008 36/50.1 |
| 2015/0040430 | A1 * | 2/2015 | Conrad | A43C 1/006 36/83 |
| 2016/0270482 | A1 | 9/2016 | Krengel | |

* cited by examiner

SHOE WITH DUAL LACE

CROSS REFERENCE TO RELATED APPLICATION

This application is a National Phase filing in the United States, under 35 USC § 371, of PCT International Patent Application PCT/EP2022/051058, filed on 19 Jan. 2022 which claims the priority of Swiss Patent Application CH 00074/21, filed 27 Jan. 2021.

BACKGROUND OF THE INVENTION

Field of the Invention

The present invention relates to the field of shoe technology and in particular to lacings for running shoes, as well as a shoe comprising such a lacing and a method for producing a shoe with a lacing of this type.

Discussion of Related Art

A plurality of different closing systems for shoes is known in the prior art. For example, hook and loop fasteners, zippers, and strap fasteners exist in addition to the predominantly used lacings.

In particular in the case of sports shoes, in particular in the case of running and tennis shoes, lacings are used almost exclusively as closure systems. Known lacings typically only have a single lacing per shoe or a single shoelace, respectively, which is fastened to the shoe in a large variety of ways and which can be threaded in a large variety of ways. Not only aesthetically appealing patterns can be attained thereby, but also a certain desired functionality. Depending on the type of sport, it can be desirable that, for example, the toe or the forefoot region, respectively, is laced tighter or looser. A frequently observed problem in the case of known lacings, however, is that even though the upper region, i.e., the region arranged closer towards the access opening of the shoe, can be tightened when tightening the shoelaces, only the lower region of the lacing, i.e., the region arranged closer to the shoe tip of the shoe, remains relatively loose. This is a problem in particular in the case of types of sport, where it is essential that the wearer can put on the shoes quickly, but a good support in the forefoot region is essential, such as, e.g., in the case of triathlon.

SUMMARY OF THE INVENTION

The above-mentioned problem is in particular due to the fact that the shoelace of a conventional lacing is guided from the shoe tip towards the access opening of the shoe through a large number of eyes or books and is deflected there. If the ends of the shoelace are now pulled, the shoe is tightened at the uppermost eyes/hooks in the region of the access opening. Due to the fact, however, that force gets lost at each eye due to friction, the lower region, i.e., the forefoot region of the shoe, is often no longer tightened at all or only marginally. It is necessary in such cases that the wearer tightens the lacing in these regions several times by hand, which is time-consuming.

It is thus the general object of the present invention to further develop the prior art in the field of lacing systems of shoes, in particular of running shoes, and to preferably overcome the disadvantages of the prior art completely or partially. In preferred embodiments, a shoe is provided, which can be laced tightly evenly with little expenditure of time over the entire region of the lacing from the shoe tip in the direction of the access opening.

The general object is solved by means of the subject matter of the independent claims. Further advantageous embodiments follow from the dependent claims as well as the description and the drawings.

In a first aspect, the general object is achieved by means of a shoe, in particular a running shoe, comprising a shoe tip and a heel edge and a lacing system. The lacing system thereby comprises a lacing, which has two end regions along the lacing, i.e., along its longitudinal direction, and a middle region adjoining between the end regions at respective branching points of the lacing. The lacing thus has a first end region, which extends all the way to a first branching point. This is adjoined by the middle region, which extends all the way to a second branching point, which is adjoined by the second end region. At the respective branching points of the lacing, the lacing branches into a first strand and a second strand or converge again, respectively. In the middle region, the first and second strand are movable relative to one another, i.e., are not connected to one another. In some embodiments, the middle region can be described as loop, which is arranged between the two end regions. The shoe has a holder comprising several holding structure pairs for fastening the lacing. A holding structure pair in each case consists of a medial-side and an opposite on the lateral side arranged holding structure. The two holding structures of one or even of each holding structure pair are preferably arranged at the same height or so as not be offset from one another in the longitudinal direction, respectively, in the longitudinal direction of the shoe, i.e., from the heel edge towards the shoe tip. The holder additionally has a first holding region, viewed from the shoe tip, comprising at least one holding structure pair, and an adjoining second holding region arranged in the direction of the heel edge, comprising at least two holding structure pairs. The second holding region typically adjoins immediately, i.e., directly, to the first holding region in the longitudinal direction of the shoe. Exclusively the first strand is thereby fastened to the holding structure pairs in the first holding region, and exclusively the second strand is fastened to the holding structure pairs in the second holding region. Only the first strand, but not the second strand is thus fastened to the holding structures or the holding structure pairs, respectively, of the first holding region, while only the second strand, but not the first strand is fastened to the holding structures or the holding structure pairs, respectively, of the second holding region. The first strand is typically fastened to all holding structures or to all holding structure pairs, respectively, in the first holding region, and the second strand is fastened to all holding structures or to all holding structure pairs, respectively, in the second holding region. For example, the first strand can thus be fastened to at least one holding structure pair of the first holding region, and the second strand can be fastened to the at least two holding structure pairs of the second holding structure region. Due to the arrangement of the lacing, it is ensured that during the tightening, the first holding region in the forefoot region and the second holding region in the middle foot region is tightened at the same time. Due to the fact that the first and second strand are connected to one another in the end regions or the lacing is not branched or split in this region, respectively, the force is distributed evenly to the first and second strand during the tightening, whereby a lacing, which is tight over the entire region, can be attained with little expenditure of time. Due to the fact that the end regions are in fact identical, in particular with regard to their material, to the end regions of a common shoelace, such a lacing can be tied in the usual way. Additional components, such as additional fastening straps, can thus be dispensed with.

In a second aspect, the general object is solved by means of a shoe, in particular running shoe, comprising a shoe tip and a heel edge and a lacing system. The lacing system comprises a first lacing and a second lacing, which is separate therefrom. The first and second lacing thereby each comprise an end region along the corresponding lacing and a middle region, which adjoins a branching point of the respective lacing and which is formed as loop. The respective lacing branches at the respective branching points. The shoe has a holder comprising several holding structure pairs for fastening the lacing, wherein the holding structure pairs each consist of a medial-side holding structure and an opposite arranged lateral-side holding structure, and wherein the holder has a from the shoe tip first holding region, comprising at least one holding structure pair, and an adjoining second holding region, which is arranged in the direction of the heel edge, comprising at least two holding structure pairs. In the first holding region, exclusively the first lacing is fastened with its middle region to the holding structures of the holding structure pairs and in the second holding region exclusively the second lacing is fastened with its middle region to the holding structures of the holding structure pairs. The second holding region typically adjoins immediately, i.e., directly, to the first holding region in the longitudinal direction of the shoe. Equivalently to the first aspect, only the first strand, but not the second strand is fastened to the holding structures or the holding structure pairs, respectively, of the first holding region, while the second lacing, but not the first lacing is fastened to the holding structures or the holding structure pairs, respectively, of the second holding region. The first lacing is typically fastened to all holding structures or to all holding structure pairs, respectively, in the first holding region, and the second lacing is fastened to all holding structures or to all holding structure pairs, respectively, in the second holding region.

The person skilled in the art understands a fastening of the lacing to the respective holding structures, in particular to be a force-locking and/or form-locking connection. Typical holding structures can be eyes, for instance, through which the lacing or the first or the second strand, respectively, is guided and is thus fastened thereto. Alternatively, the holding structures can comprise hooks, into which the lacing or the first or the second strand, respectively, is hooked and is thus fastened to the hooks.

A lacing is typically made of a textile material. The lacing can in particular have textile fibers. The lacing can thereby be a non-woven or also a woven or knitted fabric.

The end regions can typically be formed and/or dimensioned in such a way that a tying of the end regions is made possible. For example, the end regions can each have a length of at least 3 cm, in particular of at least 5 cm, along the lacing, i.e., in the longitudinal direction. The end regions preferably each have a length of 5 cm to 50 cm, preferably of 10 to 30 cm.

The first and second strand do not have to be formed continuously. It is possible, for example, that only the first strand runs continuously from the first branching point to the second branching point and that the second strand consists of two partial strands, the end of which is in each case fastened terminally to a holding structure of the second holding region, in particular fastened in a form-locking manner. It goes without saying that the same also applies for a continuous second strand and a first strand, which analogously consists of two partial strands, the respective ends of which can then be fastened terminally to a holding structure of the first holding region. It is also possible that the partial strands of the first and/or of the second strand are connected to one another by means of a connecting element. Such a connecting element can provide, for example, a force-locking connection, a material bonding connection and/or a form-locking connection. The connecting element can comprise, for example, a plug and a matching socket in order to provide a plug connection of the partial strands. Alternatively, the connecting element can be an adhesive element of an adhesive connection. Hook elements and/or clamping elements can additionally be used as connecting elements. The connecting element can releasably or irreversibly connect the respective partial strands. The person skilled in the art understands a reversible connection to be a connection, which can be released and preferably be closed again, in particular with little force, without destroying the corresponding components.

Directional indications, as they are used in the present disclosure, are to be understood as follows: The longitudinal direction L of the shoe is described by an axis from the heel edge to the shoe tip and thus extends along the longitudinal axis of the shoe. The transverse direction Q of the shoe runs transversely to the longitudinal axis and essentially parallel to the underside of the shoe or essentially parallel to the ground, respectively. The transverse direction thus runs along a transverse axis of the shoe. In connection with the present invention, the vertical direction or vertical direction V identifies a direction from the underside of the shoe in the direction of the insole or, in the operative state, in the direction of the foot of the wearer, respectively, and thus runs along a vertical axis of the shoe. The person skilled in the art understands that the medial side of the shoe in the worn state identifies the peripheral inner side of the shoe of a pair of shoes starting at the longitudinal axis. In the case of a pair of running shoes, the two medial sides thus point towards one another. In the worn state, the lateral side of the running shoe identifies the outer side of the shoe, starting at the longitudinal axis, and thus lies on the side of the outside of the foot.

In some embodiments, the lacing is in each case formed in the end regions as first strand and second strand, which are connected to one another by means of a material bonding connection, a form-locking connection or force-locking connection. In the end regions, the first and second strand thereby form a common end strand. The first and second strand can in the end regions thereby for example be twisted, adhered, welded or sewn to one another. This has the advantage that a shoe comprising such a lacing can be produced in a time-saving manner because the first and second strand can be connected first to the corresponding holding structures and can then subsequently be connected to one another by means of one of the above-mentioned methods. Alternatively, the end regions can be in one piece or integral, respectively. In such embodiments, a pre-lacing, e.g., is divided in the longitudinal direction in such a way during the production that a middle region according to the invention comprising a first and second strand and two end regions surrounding this middle region is created. Such embodiments likewise correspond to a form-locking connection because, for example, fibers of the first strand can be looped with one another with fibers of the second strand using textile technology.

In some embodiments, the first holding region can comprise at least two holding structure pairs, in particular exactly two, exactly three, or exactly four holding structure pairs. The person skilled in the art understands that these holding structure pairs are arranged one behind the other, viewed from the shoe tip, i.e., opposite to the longitudinal direction of the shoe. The first strand is usually fastened to all holding structures or to all holding structure pairs, respectively, of the first holding region. The first strand can thus be fastened to at least two holding structure pairs, in particular to exactly two, exactly three, or exactly four holding structure pairs. It is preferred that the first holding region has exactly two holding structure pairs. The more holding structure pairs are present, the greater the total friction because the lacing is subjected to partial friction at each holding structuring during the tightening.

In some embodiments, the first strand between the holding structures of the from the shoe tip first two holding structure pairs forms a crossing. In other words, the first strand crosses itself in the longitudinal direction between the from the shoe tip first holding pair structure and the second, i.e., the directly following holding structure pair. A better hold can be attained in the forefoot region thereby.

In some embodiments, the second holding region can comprise exactly two holding structure pairs.

In further embodiments, the second holding region can comprise at least three holding structure pairs, in particular exactly three or exactly four holding structure pairs. The person skilled in the art understands that these holding structure pairs are arranged one behind the other, viewed from the shoe tip, i.e., opposite to the longitudinal direction of the shoe, and adjoin the holding structure pairs of the first holding region opposite to the longitudinal direction. The second strand is usually fastened to all holding structures or to all holding structure pairs, respectively, of the second holding region. The second strand can thus be fastened to at least three holding structure pairs, in particular to exactly three or exactly four holding structure pairs.

In some embodiments, the holder has a third holding region. The third holding region thereby adjoins the second holding region opposite to the longitudinal direction of the shoe. Viewed from the shoe tip in the direction of the heel edge, the first holding region is thus arranged first, then the second holding region, and finally the third holding region. The third holding region consists of a single holding structure pair, which, viewed from the heel edge of the shoe, represents the first holding structure pair of the holder, respectively which represents the very last holding structure pair of the holder opposite to the longitudinal direction of the shoe. The first strand as well as the second strand can be fastened to the holding structures of the holding structure pair in the third holding region. It is also possible, however, that the end regions of the lacing are fastened to the holding structures of the holding structure pair in the third holding region. In such embodiments, the branching points can thus only be located along the lacing downstream from the holding structures of the holding structure pair in the third holding region. In other words, the branching points can be arranged between the holding structure pair in the third holding region and the last holding structure pair of the second holding region opposite to the longitudinal direction.

In some embodiments, the first strand runs on the medial side and/or on the lateral side from the holding structure of the holding structure pair of the third holding region directly to a holding structure of a holding structure pair of the first holding region. The first strand preferably runs on the medial side and/or on the lateral side from the holding structure of the holding structure pair of the third holding region directly to the holding structure of the first holding structure pair of the first holding region as viewed from the shoe tip, or directly to the holding structure of the last holding structure pair of the first holding region as viewed from the shoe tip.

The wording "first holding structure pair as viewed from the shoe tip" refers to the holding structure pair arranged closest to the shoe tip. Equivalently thereto, the "last holding structure pair of the first holding region as viewed from the shoe tip" refers to that holding structure pair of the first holding region, which is located closest to the heel edge opposite to the longitudinal direction and to which the second holding region then adjoins.

In some embodiments, the lacing has a connecting element, which is configured to connect partial strands of the first strand and/or of the second strand, which are separated from one another, in particular to connect them in a force-locking manner and/or in a form-locking manner. This has the advantage that a shoe comprising such a lacing can be produced in a particularly time-saving manner because the first and/or the second strand are in each case delivered as separate partial strands and/or are fastened to the corresponding holding structures and can then subsequently be connected to one another by means of a connecting element. The connecting element is preferably configured to reversibly connect partial strands of the first strand and/or of the second strand, so that the connection is reversible. A reversible connection is thereby a connection, which can be formed and separated several times, without changing the structure of the components to be connected, for instance a plug connection. The wearer can thus change the lacing himself without effort. A further step, during which the first and second strand have to be connected to one another following the fastening to the holding structure, in order to produce the end regions is dispensed with.

In some embodiments, the holding structures are formed as eyes and/or hooks.

The holding structures of the holding structure pair of the third holding region are preferably formed as eyes. In some embodiments, all of the remaining holding structures can be formed as hooks thereby.

In some embodiments, at least a portion or, alternatively, all of the holding structures is formed as hooks, and the hooks each have a constriction and a depression, which is widened compared to the constriction and adjoining the constriction. The depression can for example be formed in a tubular manner and is configured in such a way that the lacing, in particular the first strand or the second strand, can be inserted therein and is held in the depression. The constriction separates the depression from the surrounding area. Due to the fact that the depression is widened as compared to the constriction, the lacing is securely fastened to the hooks, without being able to inadvertently release from the hook.

In a third aspect, the general object is solved by means of a lacing system for a shoe, wherein the lacing comprises two end regions along the lacing and a middle region adjoining respective branching points of the lacing between the end regions, and wherein the lacing branches into a first strand and a second strand at the branching points, so that the first strand and the second strand are formed to be movable relative to one another in the middle region. In the two end regions, the first strand and the second strand are in each case connected to one another in such a way that the first strand and the second strand are formed to be immovable relative to one another in the end regions.

The person skilled in the art understands that the corresponding above embodiments of the first and second aspect are likewise applicable for the lacing system of the third aspect.

In a fourth aspect, the general object is achieved by means of a method for producing a shoe according to the first aspect and the respective disclosed embodiments thereof.

The method thereby comprises the steps of:

providing a pre-lacing comprising a first strand and a second strand, which are arranged to be freely movable relative to one another at least in a partial region;

transforming the pre-lacing into a lacing, wherein the first strand and the second strand are in each case either connected to one another by means of a material bonding connection, a form-locking connection or a force-locking connection in the two end regions thereof in such a way that the first strand and the second strand are formed to be immovable relative to one another in the end regions and are arranged to be movable relative to one another in a middle region adjoining the end regions, or wherein the first strand and the second strand of the pre-lacing are connected to one another by means of a material bonding connection, a form-locking connection or a force-locking connection in the end regions, and the first strand and/or the second strand consists of partial strands of the first strand, which are separated from one another, and/or of partial strands of the second strand, which are separated from one another and which are connected to one another by means of a connecting element to form the lacing;

exclusive fastening of the first strand to the holding structures of the at least one holding structure pair of a from the shoe tip first holding region of a shoe and exclusive fastening of the second strand to the holding structures of the at least two holding structure pairs of a second holding region of the shoe adjoining the first holding region in the direction of the heel edge of the shoe.

The person skilled in the art understands that the above steps do not have to mandatorily be performed in the disclosed order but that, for example, the first and second strand can also be fastened to the respective holding structures first, and that the pre-lacing can take place subsequently by connecting the first strand and the second strand to provide the two end regions.

In some embodiments, providing the pre-lacing comprises cutting out the pre-lacing from a flat textile comprising a through-going opening, which is delimited by the first strand and the second strand. In such embodiments, the transformation of the pre-lacing into the lacing can be dispensed with because this can take place directly by means of cutting out.

BRIEF DESCRIPTION OF SEVERAL VIEWS OF THE DRAWINGS

Aspects of the invention will be described in more detail on the basis of the exemplary embodiments shown in the following figures and the corresponding description.

DETAILED DESCRIPTION OF THE INVENTION

Figure 1:
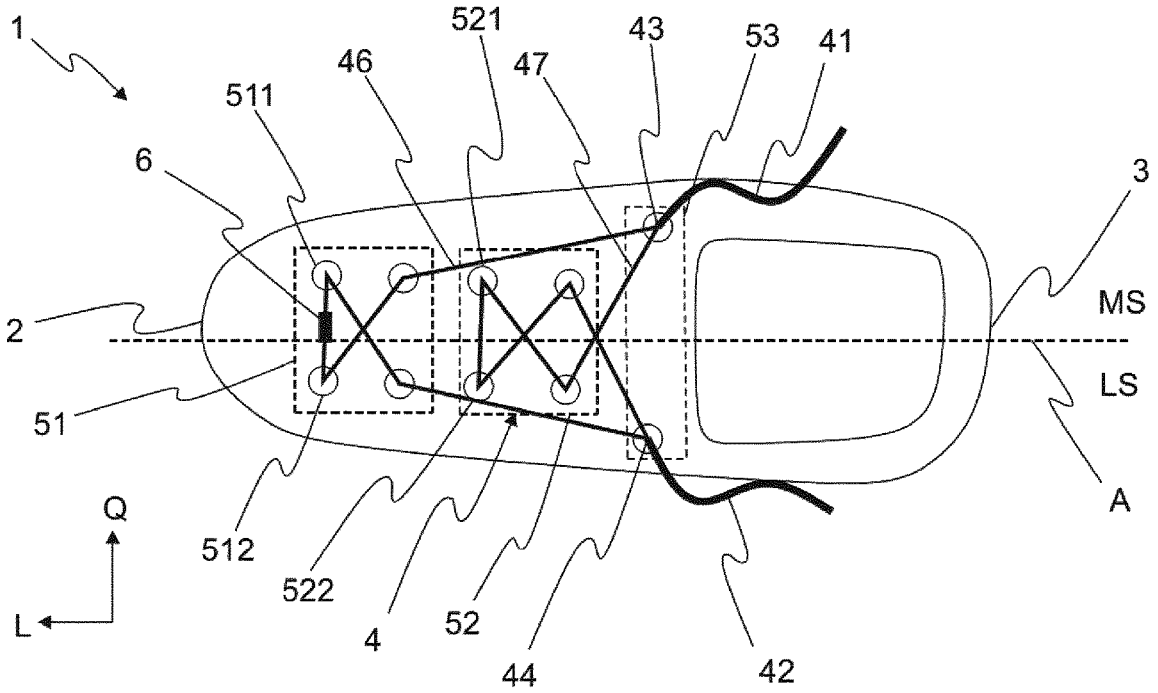
FIG. 1 shows a schematic top view of a shoe according to the invention according to an embodiment of the first aspect of the invention.

FIG. 1 shows a shoe 1 comprising a shoe tip 2, a heel edge 3, and a lacing system. The lacing system comprises a lacing 4 comprising two end regions 41 and 42. Branching points 43 and 44 adjoin the respective end regions 41 and 42 along the longitudinal direction of the lacing, i.e., in the direction of the longitudinal extension of the lacing 4. At these branching points, the lacing branches into a first strand 46 and a second strand 47, which define the middle region of the lacing. The branching is indicated by the different line thickness of the end region compared to the line thickness of the first and second strand. The shoe 1 has a holder, which comprises several holding structure pairs for fastening the lacing 4. A holding structure pair consists of two holding structures (e.g., 511 and 512; or 521 and 522; for the sake of clarity, only four of the shown ten holding structures are referenced in FIG. 1). A holding structure 511 or 521 of a holding structure pair is thereby arranged on the medial side, i.e. on the medial side MS of the longitudinal axis A of the shoe 1, which runs from the heel edge 3 to the shoe tip 2 in the longitudinal direction L, and the second holding structure 512 or 522 is thereby arranged on the lateral side, i.e. on the lateral side LS of the longitudinal axis A of the shoe 1. As illustrated in FIG. 1, the holding structures 511 and 512, which form a holding structure pair, are located at the same height in the longitudinal direction L or along the longitudinal axis A, respectively. They are thus not offset from one another in the longitudinal direction or lie on a common transverse axis, which is perpendicular to the longitudinal axis, respectively, in the transverse direction Q. Viewed from the shoe tip 2, i.e., opposite to the longitudinal direction L, the holder of the shoe 1 has a first holding region 51, which, in the shown example, has two holding structure pairs, i.e., four holding structures. Opposite to the longitudinal direction, i.e., in the direction of the heel edge 3, a second holding region 52 likewise comprising two holding structure pairs, i.e., four holding structures, adjoins the first holding region 51. Further holding regions or further holding structures, respectively, of a further holding region are generally not arranged between the first and the second holding region. Based on the first and the second holding region, the first strand 46 is thereby fastened exclusively to the holding structures of the first holding region 51 and based on the first and the second holding region, the second strand 47 is fastened exclusively to the holding structure pairs in the second holding region 52. Exclusively the first strand 46 is thus fastened to all holding structure pairs in the first holding region 51, and exclusively the second strand 47 is fastened to all holding structure pairs in the second holding region 52. The first strand 46 forms a crossing between the holding structures of the from the shoe tip first two holding structure pairs. In addition to the first holding region 51 and the second holding region 52, the holder comprises a third holding region 53, which is arranged downstream from the second region 52 opposite to the longitudinal direction and which consists of a single holding structure pair comprising two holding structures. Starting at the heel edge in the longitudinal direction L, i.e., in the direction of the shoe tip 2, the holding structure pair of the third holding region 53 represents the very first holding structure pair of the holder. The first strand as well as the second strand are fastened to the holding structures of the holding structure pair in the third holding region 53, respectively, in the present case, the branching points 43 and 44 are fastened to the holding structures of the third holding region 53. The lacing 4 additionally has a connecting element 6, which connects two partial strands of the first strand 46 to one another. Such a connecting element allows for a quick and simple fastening of the lacing, in particular when the holding structures of the first region 51, to which the partial strands of the first strand 46 are fastened, are formed as eyes.

Figure 2:
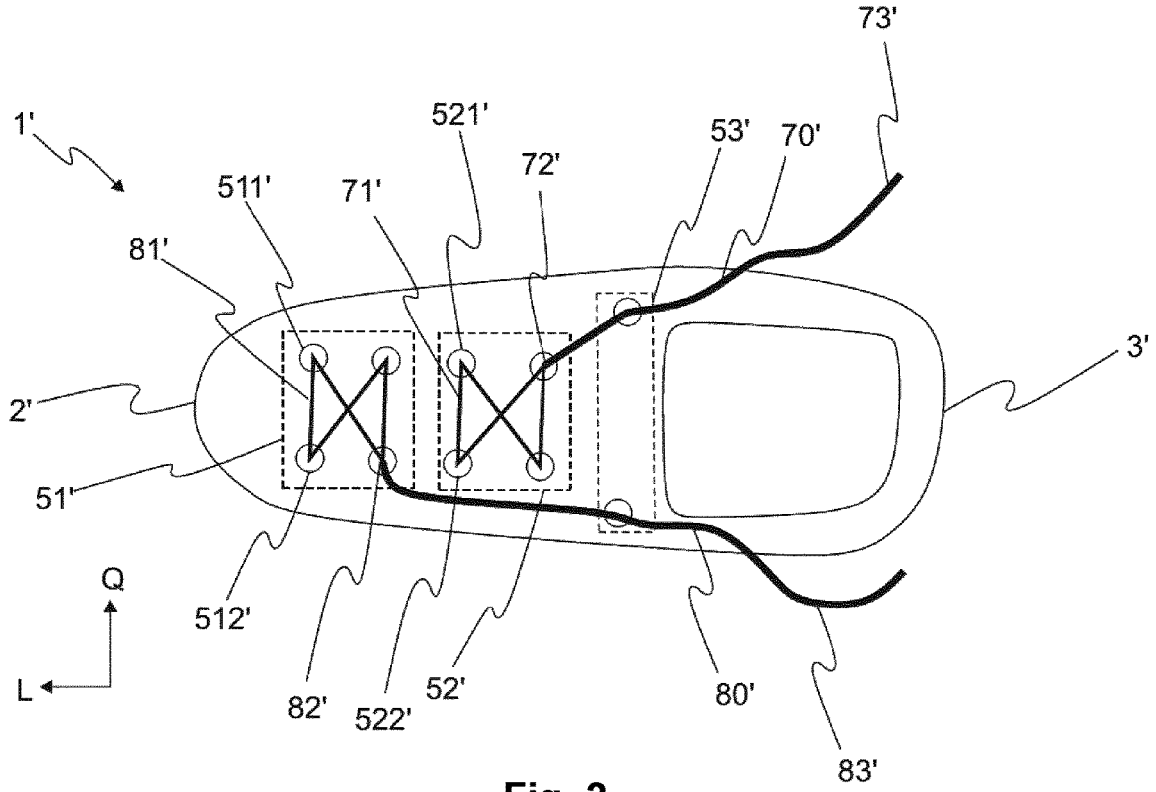
FIG. 2 shows a schematic top view of a shoe according to the invention according to an embodiment of the second aspect of the invention.

An embodiment of the shoe 1' according to the second aspect of the invention is shown in FIG. 2. In contrast to the embodiments of the first aspect, which generally have only a single lacing, the shoe 1' has two separate lacings 70' and 80'. Along the lacing, i.e., along the respective longitudinal extension thereof, the lacings thereby each comprise an end region 73' and 83' as well as an adjoining branching point 72' and 82'. At the branching points, the respective lacings 70' and 80' branch in their middle regions 71' and 81' to form a closed loop. The shoe 1' has a holder, which comprises several holding structure pairs for fastening the lacings 70' and 80'. A holding structure pair consists of two holding structures (e.g. 511' and 512'; or 521' and 522'; for the sake of clarity, only four of the shown ten holding structures are referenced in FIG. 1). A holding structure 511' or 521' of a holding structure pair is thereby arranged on the medial side, and the second holding structure 512' or 522' is thereby arranged on the lateral side. Viewed from the shoe tip 2', i.e., opposite to the longitudinal direction L of a first holding region 51', the holder of the shoe 1' has a first holding region 51', which, in the shown example, has two holding structure pairs, i.e., four holding structures. Opposite to the longitudinal direction, i.e., in the direction of the heel edge 3', a second holding region 52' likewise comprising holding structure pairs, i.e., four holding structures, adjoins the first holding region 51'. Further holding regions or further holding structures of a further holding region, respectively, are generally not arranged between the first and the second holding region. Exclusively the first lacing 80' or the middle region 81' thereof, respectively, is thereby fastened to all holding structures of the first holding region 51', and exclusively the second lacing 70' or the middle region 71' thereof, respectively, is fastened to all holding structures of the second holding region 52'. In addition to the first holding region 51' and the second holding region 52', the holder comprises a third holding region 53', which is arranged downstream from the second region 52' opposite to the longitudinal direction and which consists of a single holding structure pair comprising two holding structures. Starting at the heel edge in the longitudinal direction L, i.e., in the direction of the shoe tip 2', the holding structure pair of the third holding region 53' represents the very first holding structure pair of the holder. Exclusively the first lacing 80' is fastened to a holding structure, in the present case the lateral-side holding structure, of the holding structure pair of the third holding region 53', while exclusively the second lacing 70' is fastened to the other holding structure, which is arranged on the medial side, of the holding structure pair of the third holding region 53'.

Figure 3:
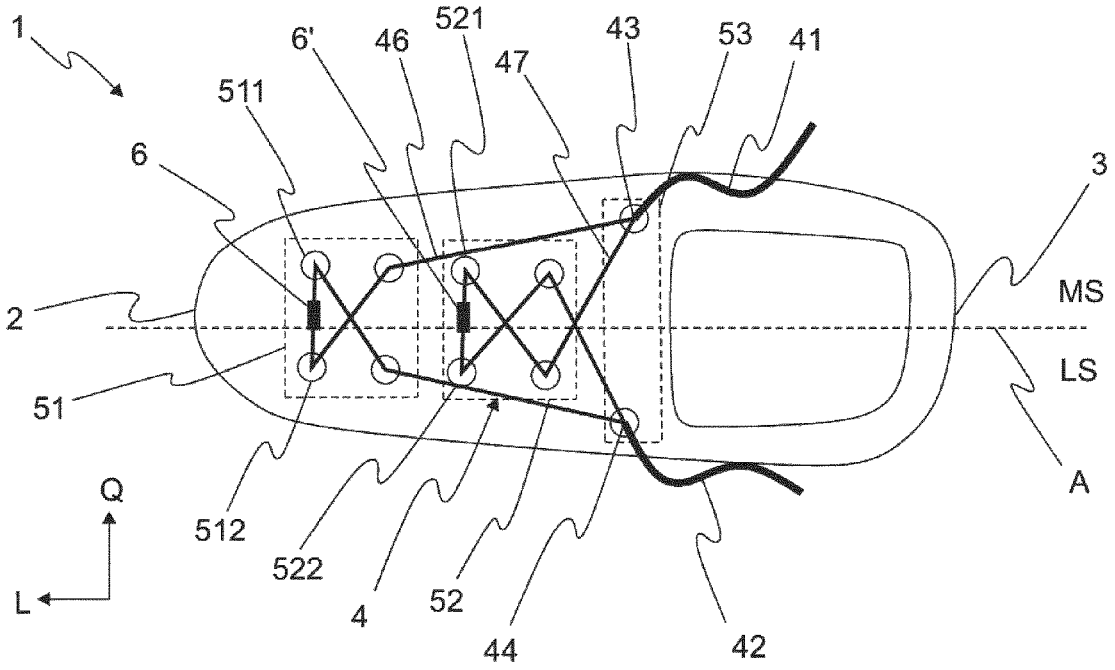
FIG. 3 shows a schematic top view of a shoe according to the invention according to a further embodiment of the first aspect of the invention.

A further embodiment of the shoe 1 according to the first aspect of the invention is shown in FIG. 3. This embodiment differs from the embodiment shown in FIG. 1 in that the lacing 4 has two connecting elements 6 and 6'. As in the embodiment according to FIG. 1, the connecting element 6 connects two partial strands of the first strand 46 to one another. The second connecting element 6' connects to partial strands of the second strand 47 to one another. As illustrated, the first connecting element 6 is arranged in the first holding region 51, and the second connecting element 6 in the second holding region 52. A particularly quick and simple exchangeable lacing is provided by means of the connecting elements.

Figure 4:
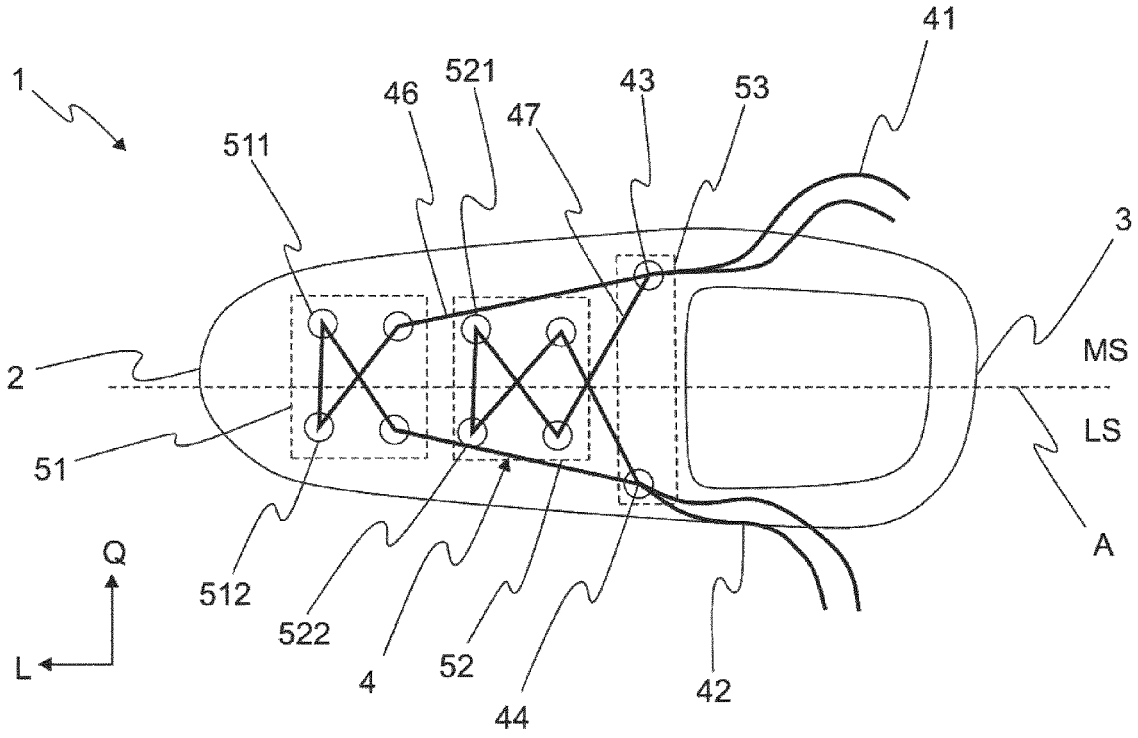
FIG. 4 shows a schematic top view of a shoe according to the invention according to a further embodiment of the first aspect of the invention.

A not yet completed shoe 1 according to a further embodiment of the invention is illustrated in FIG. 4. The first and second strand of the lacing was thereby already fastened to the respective holding structures. However, FIG. 4 shows the shoe prior to the connection of the first and second strand in the end regions. In a following step, the loose ends of the first and second strand can be connected to one another, for example, by means of twisting, adhering, or welding in such a way that the first strand and the second strand are formed to be immovable relative to one another in the end regions. In such an embodiment, a connecting element is not necessary because the first and second strand are connected to one another only after the fastening to the holding structure pairs.

Figure 5:
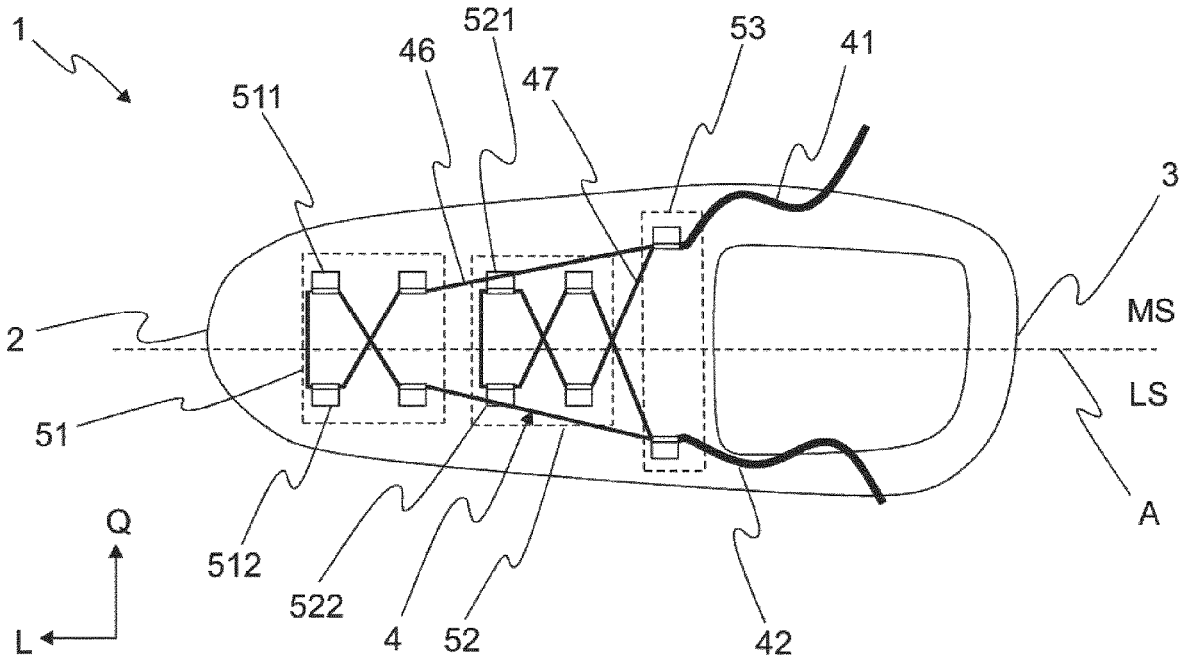
FIG. 5 shows a schematic top view of a shoe according to the invention according to a further embodiment of the first aspect of the invention.

A further embodiment of the shoe 1 according to the first aspect of the invention is shown in FIG. 5. This embodiment differs from the embodiment shown in FIG. 1 in that all holding structures are formed as hooks and not as eyes. Such hooks am designed so that the first strand 46 and the second strand 47 can be placed quickly into the hooks. This makes it superfluous to subsequently connect the first and second strand in the end region or to connect partial strands of the first and/or of the second strand by means of connecting elements, whereby the lacing can be attached to the shoe and can be exchanged more quickly.

Figure 6A:
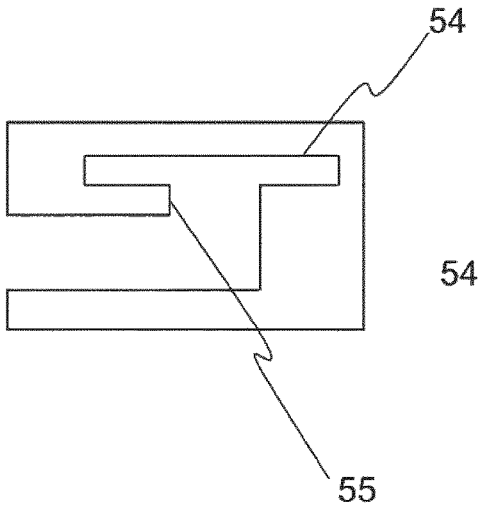
FIG. 6*a* shows a cross section of a hook as connecting element, as it is used in some embodiments of the first aspect of the invention.
Figure 6B:
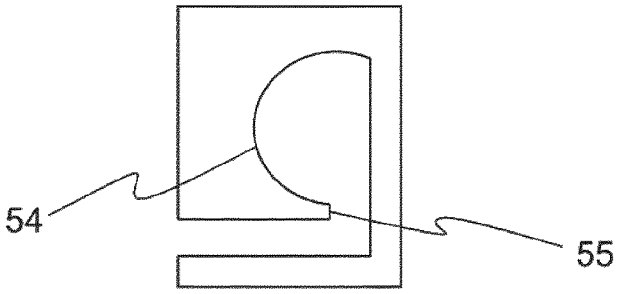
FIG. 6*b* shows a cross section of a hook as connecting element, as it is used in some embodiments of the second aspect of the invention.

FIGS. 6*a* and 6*b* in each case shows a holding structure in the cross section, which is formed as hook. The lacing can thereby be inserted through the constriction 55 into the depression 54, which is widened compared to the constriction, where the lacing is held securely due to the constriction. With the exception of the two holding structures of the third holding region 53, 53', all holding structures can be formed, for example, as books of this type.

The invention claimed is:

1. A shoe (1) comprising:

a shoe tip (2) and a heel edge (3) and a lacing system, wherein the lacing system comprises a lacing (4), wherein the lacing comprises two end regions (41, 42) along the lacing and a middle region adjoining between the end regions (41, 42) at respective branching points (43, 44) of the lacing, and wherein the lacing branches to divide the lacing into a first strand (46) and a second strand (47) at the respective branching points (43, 44); and wherein the shoe has a holder comprising several holding structure pairs for fastening the lacing (4), wherein each of the several holding structure pairs comprises a medial-sided and an oppositely arranged lateral-sided holding structure (511, 512, 521, 522), and wherein one end region (41) extends toward a medial side and one end region (42) extends toward a lateral side such that the shoe can be tied, and wherein the holder has a first holding region (51), the first holding region (51) comprising at least two holding structure pairs, and an adjoining second holding region (52) arranged between the first holding region (51) and the heel edge (3), the second holding region (52) comprising at least two holding structure pairs, wherein the first holding region (51) is closer to the shoe tip than the second holding region (52); and wherein exclusively the first strand (46) is fastened to the holding structure pairs in the first holding region (51), and exclusively the second strand (47) is fastened to the holding structure pairs in the second holding region (52), wherein the at least two holding structure pairs in the first holding region comprise a first holding structure pair and a directly subsequent holding structure pair, the first holding structure pair is closer to the shoe tip than the directly subsequent holding structure pair, and the first strand crosses itself between the first holding structure pair and the directly subsequent holding structure pair.

2. The shoe (1) according to claim 1, wherein the lacing (4) is formed in each of the two end regions (41, 42) as the first strand and the second strand, which are connected to one another by means of a material bonding connection, a form-locking connection or force-locking connection.

3. The shoe (1) according to claim 1, wherein the holder comprises a third holding region (53), wherein the third holding region (53) adjoins the second holding region (52), and the third holding region (53) consists of a single holding structure pair, which, viewed from the heel edge (3) of the shoe, represents the first holding structure pair of the holder.

4. The shoe (1) according to claim 3, wherein the first strand (46) runs on the medial side and/or on the lateral side from a holding structure of the holding structure pair of the third holding region (53) directly to a holding structure of a holding structure pair of the first holding region (51).

5. The shoe (1) according to claim 3, wherein the first strand (46) and the second strand (47) are fastened to the holding structures of the holding structure pair of the third holding region (53), in a region of the two end regions (41, 42) or of the two branching points (43, 44).

6. The shoe (1) according to claim 1, wherein the lacing (4) has a connecting element (6), which is configured to connect partial strands of the first strand (46) and/or of the second strand (47), which are separated from one another, to connect them in a form-locking manner and/or in a force-locking manner.

7. The shoe (1) according to claim 6, wherein the connecting element (6) is configured to reversibly connect partial strands of the first strand (46) and/or of the second strand (47).

8. The shoe (1) according to claim 1, wherein the holding structures are formed as eyes and/or hooks.

9. The shoe according to claim 8, wherein at least a portion of the holding structures are formed as hooks, and wherein the hooks each have a constriction (55) and a depression (54), which is widened compared to the constriction and connected to the constriction.

10. The shoe (1) according to claim 1, wherein holding structures of a holding structure pair of a third holding region (53) are formed as eyes.

11. The shoe (1) according to claim 10, wherein the remaining holding structures are formed as hooks.

12. The shoe (1) according to claim 1, wherein the first strand (46) and the second strand (47) are formed to be movable relative to one another in the middle region.

13. The shoe according to claim 1, wherein the holder is free of fastening straps.

14. A method for producing the shoe according to claim 1, comprising the steps of:

providing the shoe tip, the heel edge, the medial side, and the lateral side of the shoe;

providing the holder of the shoe comprising the several holding structure pairs for fastening the lacing, wherein each of the several holding structure pairs comprises the medial-sided and the oppositely arranged lateral-sided holding structure, wherein the holder has the first holding region, the first holding region comprising at the least two holding structure pairs in the first holding region, and the holder has the adjoining second holding region arranged between the first holding region and the heel edge, the second holding region comprising the at least two holding structure pairs in the second holding region, wherein the first holding region is closer to the shoe tip than the second holding region and wherein the at least two holding structure pairs in the first holding region comprise the first holding structure pair and the directly subsequent holding structure pair, the first holding structure pair is closer to the shoe tip than the directly subsequent holding structure pair;

providing a pre-lacing comprising the first strand and the second strand, which are arranged to be freely movable relative to one another at least in a partial region;

transforming the pre-lacing into the lacing of the lacing system of the shoe comprising the two end regions along the lacing and the middle region adjoining between the end regions at the respective branching points of the lacing wherein the lacing branches to divide the lacing into the first strand and the second strand at the respective branching points, wherein the transforming of the pre-lacing into the lacing comprises one of:

the first strand and the second strand are connected to one another in the two end regions by means of a material bonding connection, a form-locking connection or a force-locking connection, and the first strand and the second strand are formed to be immovable relative to one another in the end regions and are arranged to be movable relative to one another in the middle region adjoining the end regions, and:

the first strand and the second strand of the pre-lacing are connected to one another in the end regions by means of a material bonding connection, a form-locking connection or a force-locking connection, and the first strand and/or the second strand consists of partial strands of the first strand, and/or of the second strand, which are separated from one another and which are connected to one another by means of a connecting element to form the lacing;

providing one end region extending toward the medial side and one end region extending toward the lateral side such that the shoe can be tied;

exclusive fastening of the first strand to the holding structures of the at least two holding structure pairs in the first holding region of the shoe wherein the first strand crosses itself between the first holding structure pair and the directly subsequent holding structure pair, and exclusive fastening of the second strand to the holding structures of the at least two holding structure pairs in the second holding region of the shoe adjoining the first holding region.

15. The method according to claim 14, wherein providing the pre-lacing comprises cutting out the pre-lacing from a flat textile comprising a through-going opening, which is delimited by the first strand and the second strand.

16. A shoe (1) comprising:

a shoe tip (2) and a heel edge (3) and a lacing system, wherein the lacing system comprises a lacing (4), wherein the lacing comprises two end regions (41, 42) along the lacing and a middle region adjoining between the end regions (41, 42) at respective branching points (43, 44) of the lacing, and wherein the lacing branches to divide the lacing in the end regions (41, 42) into a first strand (46) and a separate second strand (47) at the respective branching points (43, 44);

wherein the shoe has a holder comprising several holding structure pairs for fastening the lacing (4), wherein each of the holding structure pairs comprises a medial-sided and an oppositely arranged lateral-sided holding structure (511, 512, 521, 522), wherein the medial-sided and lateral-sided holding structure of each holding structure pair are arranged on a straight line essentially perpendicular to a longitudinal axis extending between the heel edge and the shoe tip, and wherein one end region (41) extends toward a medial side and one end region (42) extends toward a lateral side such that the shoe can be tied, and wherein the holder has a first holding region (51), the first holding region (51) comprising at least two holding structure pairs, and an adjoining second holding region (52) arranged between the first holding region (51) and the heel edge (3), the second holding region (52) comprising at least two holding structure pairs, wherein the first holding region (51) is closer to the shoe tip than the second holding region (52); and wherein exclusively the first strand (46) is fastened to the holding structure pairs in the first holding region (51), and exclusively the second strand (47) is fastened to the holding structure pairs in the second holding region (52) wherein the at least two holding structure pairs in the first holding region comprise a first holding structure pair and a directly subsequent holding structure pair, the first holding structure pair is closer to the shoe tip than the directly subsequent holding structure pair, and the first strand crosses itself between the first holding structure pair and the directly subsequent holding structure pair.

* * * * *